US005149452A

United States Patent [19]

MacAlpine et al.

[11] Patent Number: 5,149,452

[45] Date of Patent: Sep. 22, 1992

[54] WAX ISOMERATE HAVING A REDUCED POUR POINT

[75] Inventors: Gerald A. MacAlpine; Partick M. E. Halls; Andre E. Asselin, all of Ontario, Canada

[73] Assignee: Exxon Research and Engineering Company, Florham Park, N.J.

[21] Appl. No.: 630,466

[22] Filed: Dec. 19, 1990

[51] Int. Cl.[5] ..... C10M 173/00

[52] U.S. Cl. ..... 252/56 R; 252/51.5 A; 252/51.5 R

[58] Field of Search ..... 252/56 R, 51.5 R, 51.5 A

[56] References Cited

U.S. PATENT DOCUMENTS 2,655,479 10/1953 Munday, et al. ..... 252/56
3,607,749 9/1971 Forbes ..... 252/56 R
3,764,537 10/1973 MacLeod ..... 252/56 R
4,956,111 9/1990 Wilburn et al. ..... 252/56 R
4,968,444 11/1990 Knoell et al. ..... 252/56 R

FOREIGN PATENT DOCUMENTS 0140274 10/1984 European Pat. Off. .
0321307 6/1989 European Pat. Off.
2407259 5/1979 France.
9009363 8/1990 PCT Int'l Appl.

OTHER PUBLICATIONS

Gr. Britain 1,559,952 is English language equivalent.

*Primary Examiner*—Brian E. Hearn
*Assistant Examiner*—M. Nuzzolillo
*Attorney, Agent, or Firm*—John W. Ditsler

[57] ABSTRACT

A combination of a low and a high molecular weight polyalkylmethacrylate has been found to be effective in reducing the pour point of a wax isomerate to a level that cannot be obtained with conventional pour point depressants. In a preferred embodiment, the wax isomerate is a slack wax isomerate.

12 Claims, No Drawings

WAX ISOMERATE HAVING A REDUCED POUR POINT

BACKGROUND OF THE INVENTION

1. Field of the Invention

This invention concerns the use of a combination of low and high molecular weight polyalkylmethacrylates to reduce the pour point of a wax isomerate.

2. Description of Related Art

The addition of polyalkylmethacrylates to lubricating oils is known. For example, U.S. Pat. No. 2,628,225 discloses that polyalkylmethacrylates can be used as VI improvers and pour point depressants in lubricating oils. More recently, European Patent Application D 140 247 discloses that the pour point of a lubricating oil can be reduced by adding a mixture of acrylate or methacrylate polymers. Each polymer contains several acrylate or methacrylate esters. The molecular weight of both polymers ranges from 50,000 to 500,000.

However, neither reference suggests reducing the pour point of a wax isomerate using the particular combination of low and high molecular weight polyalkylmethacrylates as described below.

SUMMARY OF THE INVENTION

This invention relates to reducing the pour point of wax isomerates, alone or in combination with a conventional lubricating oil basestock. More specifically, a synergistic mixture of low and high molecular weight polyalkylmethacrylates has been found to be effective in reducing the pour point of wax isomerates. In a preferred embodiment, the wax isomerate is a slack wax isomerate.

DETAILED DESCRIPTION OF THE INVENTION

This invention requires a wax isomerate, a high molecular weight polyalkylmethacrylate, and a low molecular weight polyalkylmethacrylate.

The wax isomerates used in this invention are the lubes fraction remaining following dewaxing the isomerate formed from isomerizing wax in the presence of a suitable catalyst under isomerization conditions.

The wax which is isomerized may originate from any number of sources. Synthetic waxes from Fischer-Tropsch processes may be used, as may be waxes recovered from the solvent or autorefrigerative dewaxing of conventional hydrocarbon oils, or mixtures of these waxes. Waxes from dewaxing conventional hydrocarbon oils are commonly called slack waxes and usually contain an appreciable amount of oil. The oil content of these slack waxes can range anywhere from 0 to 45% or more, but usually from 5 to 30% oil.

Isomerization is conducted over a catalyst containing a hydrogenating metal component—typically one from Group VI, or Group VIII, or mixtures thereof, preferably Group VIII, more preferably noble Group VIII, and most preferably platinum on a halogenated refractory metal oxide support. The catalyst typically contains from 0.1 to 5.0 wt. %, preferably 0.1 to 1.0 wt. %, and most preferably from 0.2 to 0.8 wt. % metal. The halogenated metal oxide support is typically an alumina (e.g. gamma or eta) containing chlorides (typically from 0.1 to 2 wt. %, preferably 0.5 to 1.5 wt. %) and fluorides (typically 0.1 to 10 wt. %, preferably 0.3 to 0.8 wt. %).

Isomerization is conducted under conditions of temperatures between about 270° to 400° C. (preferably between 300° to 360° C.), at pressures of from 500 to 3000 psi $H_2$ (preferably 1000–1500 psi $H_2$), at hydrogen gas rates of from 1000 to 10,000 SCF/bbl, and at a space velocity in the range of from 0.1 to 10 v/v/hr, preferably from 1 to 2 v/v/hr.

Following isomerization, the isomerate may undergo hydrogenation to stabilize the oil and remove residual aromatics. The resulting product may then be fractionated into a lubes cut and fuels cut, the lubes cut being identified as that fraction boiling in the 330° C.+ range, preferably the 370° C.+ range, or even higher. This lubes fraction is then dewaxed to reduce the pour point, typically to between about −15° to about −24° C. This fraction is the "wax isomerate" to which the high and low polyalkylmethacrylates combination of this invention is added. The polyalkylmethacrylate combination may also be added to a lubricating oil comprising a major amount of wax isomerate, a minor amount of the additive combination, and a minor amount of a lubricating oil basestock (such as is described in U.S. Pat. No. 4,906,389, the disclosure of which is incorporated herein by reference).

The low molecular weight polyalkylmethacrylate used in this invention should have a weight average molecular weight ranging from about 10,000 to about 50,000, preferably from about 30,000 to about 45,000, as measured by gel permeation chromatography (GPC) using polystyrene as the calibrant. The amount of low molecular weight polyalkylmethacrylate added can range from about 0.01 up to 5 wt. % or more. Practically, however, the amount of low molecular weight polyalkylmethacrylate will range from about 0.1 to about 1 wt. %, most preferably from about 0.3 to about 0.7 wt. %, based on weight of the final product.

The high molecular weight polyalkylmethacrylate should have a weight average molecular weight ranging from about 70,000 to about 150,000, preferably from about 90,000 to about 120,000, as measured by GPC. The amount of high molecular weight polyalkylmethacrylate can range from about 0.01 up to 3 wt. % or more. Practically, however, the amount of high molecular weight polyalkylmethacrylate will range from about 0.1 to about 1 wt. %, most preferably from about 0.2 to about 0.6 wt. %, based on weight of the final product.

The alkyl group comprising the low and high polyalkylmethacrylates used in this invention may be straight chained or branched and should contain from 6 to 22, preferably from 8 to 19, carbon atoms. These polyalkylmethacrylates are known articles of commerce and, as such, are readily available in the marketplace. Frequently, the polyalkylmethacrylates are available from vendors in mixture with a solvent.

This invention will be better understood by reference to the following Examples, which include a preferred embodiment of this invention, but are not intended to restrict the scope of the claims appended hereto.

EXAMPLE 1

Use of Low and High MW Polyalkylmethacrylates in Slack Wax Isomerate Basestock The pour points of several samples of a slack wax isomerate (SWI) basestock containing various combinations of low and high molecular weight (MW) polyalkylmethacrylates (PMA) were determined using ASTM D-97. The results of these tests are shown in Table 1 below:

TABLE 1

| Sample | A | B | C | D | E | F |
|---|---|---|---|---|---|---|
| Composition, wt. % | | | | | | |
| SWI (1) | 100 | 99.5 | 99.5 | 97.0 | 98.0 | 99.0 |
| High MW PMA (2) | — | 0.5 | — | — | 0.5 | 1.0 |
| Low MW PMA (3) | — | — | 0.5 | 3.0 | 1.5 | — |
| Pour Point, °C. | −21 | −33 | −30 | −33 | −42 | −33 |

(1) Has a viscosity index of about 140, greater than 99% saturates, an initial boiling point of 363° C., a mid boiling point of 465° C., and a final boiling point of 569° C.
(2) A commercial lube oil pour point depressant having a weight average molecular weight of about 92,000.
(3) A commonly used lube oil VI improper having a weight average molecular weight of about 43,000.

The data in Table 1 show that the pour point of the SWI basestock can be depressed to −33° C. with 0.5% of the high MW PMA (Sample B). However, increasing the concentration of high MW PMA (Sample F) does not depress the pour point further. The low MW PMA also acts as a pour depressant (Samples C and D), but even at a concentration of 3.0% (Sample D), the pour point is still only −33° C. However, addition of the low MW PMA to Sample B reduced the pour point to −42° C. (Sample E), which clearly illustrates the synergistic effect of the combination of low and high MW PMA's.

EXAMPLE 2

Use of Low and High MW Polyalkylmethacrylates in Fully Formulated Slack Wax Isomerate The pour point of several samples of a fully formulated SWI containing various combinations of low and high molecular weight polyalkylmethacrylates were determined using ASTM D-97. The results of these tests are summarized in Table 2 below.

TABLE 2

| Sample | G | H | I | J |
|---|---|---|---|---|
| Composition, wt. % | | | | |
| SWI (1) | | 57.7 | | |
| 600 Neutral | | 20.0 | | |
| VI Improper (2) | 9.3 | 8.8 | 6.3 | — |
| Other additives (3) | | 12.6 | | |
| High MW PMA (1) | | 0.4 | | |
| Low MW PMA (1) | — | 0.5 | 3.0 | 9.3 |
| Pour Point, °C. | −36 | −42 | −42 | −45 |

(1) Same as corresponding notes in Table 1.
(2) A commercial VI improper containing functionalized ethene/propane copolymer and having a weight average molecular weight of about 60,200.
(3) Includes antifoaming agents, antioxidants, antiwear agents, detergents, dispersants, and friction modifiers.

The data in Table 2 show that the combination of the high MW PMA and the low PMA in a fully formulated oil resulted in a pour point of −42° C. (Sample H) compared to −36° C. (Sample G) for the blend containing only the high MW PMA. Increasing the concentration of the low MW PMA to very high levels (Sample J) can result in even lower pour points.

EXAMPLE 3

Use of Various High MW VI Improvers

The pour point of several samples of a SWI basestock in combination with various high molecular weight polymer commercial VI improvers were determined using ASTM D-97. The results of these tests are shown in Table 3 below.

TABLE 3

| Sample | K | L | M | N | O | P |
|---|---|---|---|---|---|---|
| Composition, wt. % | | | | | | |
| SWI (1) | | | 97.5 | | | |
| High MW PMA (1) | | | 0.5 | | | |
| VI Improvers | | | | | | |
| A (2) | 2 | — | — | — | — | — |
| B (3) | — | 2 | — | — | — | — |
| C (4) | — | — | 2 | — | — | — |
| D (5) | — | — | — | 2 | — | — |
| E (6) | — | — | — | — | 2 | — |
| Low MW PMA (1) | — | — | — | — | — | 2 |
| Pour Point, °C. | −33 | −33 | −33 | −36 | −33 | −42 |

(1) Same as corresponding notes in Table 1.
(2) A commercial VI improver containing styrene-isoprene copolymer and having a weight average molecular weight of about 197,000.
(3) A commercial VI improver containing styrene-butadiene copolymer and having a weight average molecular weight of about 140,000.
(4) A commercial VI improver containing functionalized ethene/propene copolymer and having a weight average molecular weight of about 60,200.
(5) A commercial VI improver containing polyalkylmethacrylate and having a weight average molecular weight of about 325,000.
(6) A commercial VI improver containing polyalkylmethacrylate and an olefin copolymer and having a weight average molecular weight of about 121,000.

The data in Table 3 show that not all combinations of the high MW PMA of this invention and other high molecular weight VI improvers are effective in depressing the pour point. Only the combination of low and high molecular weight polyalkylmethacrylates effectively depressed the pour point.

What is claimed is:

1. A wax isomerate having a reduced pour point which comprises (a) a major amount of a wax isomerate, and (b) an additive combination of (i) from about 0.01 to about 5 wt. % of a low molecular weight polyalkylmethacrylate having a weight average molecular weight ranging from about 10,000 to about 50,000, and (ii) from about 0.1 to about 1 wt. % of a high molecular weight polyalkylmethacrylate having a weight average molecular weight ranging from about 70,000 to about 150,000.

wherein the amount of (i) and (ii) are synergistically effective in reducing the pour point of the isomerate thus formed to a lower pour point than would have been obtained using the low molecular weight polyalkylmethacrylate or high molecular weight polyalkylmethacrylate alone.

2. The wax isomerate of claim 1 wherein the low molecular weight polyalkylmethacrylate has a weight average molecular weight ranging from about 30,000 to about 45,000.

3. The wax isomerate of claim 1 wherein the high molecular weight polyalkylmethacrylate has a weight average molecular weight ranging from about 90,000 to about 120,000.

4. The wax isomerate of claim 1 wherein the alkyl group in the low and high molecular weight polyalkylmethacrylates has from 6 to 22 carbon atoms.

5. The wax isomerate of claim 1 which also contains a minor amount of a lubricating oil basestock.

6. A slack wax isomerate having a reduced pour point which comprises (a) a major amount of a slack wax isomerate, (b) from about 0.01 to about 5 wt. % of a low molecular weight polyalkylmethacrylate having a weight average molecular weight ranging from about 10,000 to about 50,000, and (c) from about 0.1 to about 1 wt. % of a high molecular weight polyalkylmethacrylate having a weight average molecular weight ranging from about 70,000 to about 150,000, wherein the amount of (b) and (c) are synergistically effective in reducing the pour point of the slack wax isomerate thus formed to a lower pour point than would have been obtained using the low molecular weight polyalkylmethacrylate or the high molecular weight polyalkylmethacrylate alone.

7. The slack wax isomerate of claim 6 wherein the amount of low molecular weight polyalkylmethacrylate ranges from 0.3 to about 0.7 wt. % and the amount of high molecular weight polyalkylmethacrylate ranges from about 0 2 to about 0.6 wt. %.

8. The slack wax isomerate of claim 7 wherein the low molecular weight polyalkylmethacrylate has a weight average molecular weight ranging from about 30,000 to about 45,000.

9. The slack wax isomerate of claim 8 wherein the high molecular weight polyalkylmethacrylate has a molecular weight ranging from about 90,000 to about 120,000.

10. The slack wax isomerate of claim 6 wherein the high molecular weight polyalkylmethacrylate has a molecular weight ranging from about 90,000 to about 120,000.

11. A lubricating oil containing a major amount of the slack wax isomerate of claim 6 and a minor amount of a lubricating oil basestock.

12. The slack wax isomerate of claim 6 wherein the amount of the low molecular weight polyalkylmethacrylate and the high molecular weight polyalkylmethacrylate each ranges from about 0.1 to about 1.0 wt. %.

* * * * *